US008584582B2

(12) United States Patent
Johannesen, Jr.

(10) Patent No.: US 8,584,582 B2
(45) Date of Patent: Nov. 19, 2013

(54) LID CONSTRUCTION FOR COMPRESSING CONTENT OF A CONTAINER

(75) Inventor: Arvid Johannesen, Jr., Fyllingsdalen (NO)

(73) Assignee: MPE Prodvers AS, Bergen (NO)

( * ) Notice: Subject to any disclaimer, the term of this patent is extended or adjusted under 35 U.S.C. 154(b) by 86 days.

(21) Appl. No.: 12/737,236

(22) PCT Filed: Apr. 17, 2009

(86) PCT No.: PCT/NO2009/000148
§ 371 (c)(1),
(2), (4) Date: Apr. 15, 2011

(87) PCT Pub. No.: WO2009/151333
PCT Pub. Date: Dec. 17, 2009

(65) Prior Publication Data

US 2011/0203464 A1 Aug. 25, 2011

(30) Foreign Application Priority Data

Jun. 9, 2008 (NO) ..... 20082543

(51) Int. Cl.
*B30B 1/00* (2006.01)

(52) U.S. Cl.
USPC ..... 100/226; 100/227; 100/246; 100/247; 100/255; 100/265; 100/281; 100/282; 100/283; 100/292; 100/293

(58) Field of Classification Search
USPC ..... 100/226, 227, 246, 247, 255, 265, 281, 100/282, 283, 292, 293
See application file for complete search history.

(56) References Cited

U.S. PATENT DOCUMENTS

| | | | | | |
|---|---|---|---|---|---|
| 2,475,692 | A * | 7/1949 | Borzym | 76/4 |
| 3,919,932 | A * | 11/1975 | Basuino | 100/228 |
| 4,024,804 | A * | 5/1977 | Hanson | 100/5 |
| 4,991,500 | A * | 2/1991 | Knapp | 100/90 |
| 5,042,374 | A * | 8/1991 | Klepacki | 100/229 A |
| 5,167,750 | A * | 12/1992 | Myers | 156/583.9 |
| 5,832,818 | A * | 11/1998 | Menzak, Jr. | 100/92 |
| 6,058,834 | A * | 5/2000 | Beckwith | 100/99 |
| 6,851,357 | B1 * | 2/2005 | Martorella et al. | 100/226 |
| 6,951,357 | B2 * | 10/2005 | Armstrong et al. | 296/57.1 |
| 7,237,480 | B2 * | 7/2007 | Ruddock | 100/226 |

* cited by examiner

*Primary Examiner* — Dana Ross
*Assistant Examiner* — Onekki Jolly
(74) *Attorney, Agent, or Firm* — Francis C. Hand; Carella, Byrne, et al

(57) ABSTRACT

A lid construction is described for compression of the content of a container, where a body in connection to the lid of the container is set up to create a pressure down onto the content such that it is compressed. It is characterized in that it comprises a moment arm construction which on rotation is set up to push the element down to its active position, and to be pulled up to its passive, rest position. The moment arm construction is preferably integrated in the lid, and it comprises compacting a relatively longer arm part (40*a*,40*b*) which is firmly connected to the relatively shorter arm part (48*a*,48*b*), and where the moment arm is rotary mounted in the lid. Also described is a construction of a docking station for a waste container and where the lid construction is integrated. Application of the inventions is also described.

12 Claims, 7 Drawing Sheets

LID CONSTRUCTION FOR COMPRESSING CONTENT OF A CONTAINER

The present invention relates to a device for a lid construction for the compression of the content of a container, where an element in connection to the lid is set up to press down upon the content so that this is compressed, as can be seen in the introduction in the subsequent claim 1.

The invention also relates to a new construction for a docking station for storing and filling of a waste container. Applications of the lid construction are also described.

There are previously known solutions of the above mentioned type built into lid constructions, where a plate formed compacting element is connected with a threaded rod that pushes the plate down in a compacting function. The threaded rod is screwed down through a correspondingly formed threaded boring in the lid. In that the lower end of the threaded rod is rotary mounted to a seat in the topside of the plate, the compacting function is exerted.

Solutions of the above mentioned type for compression of waste is known, for example, German Patent DE 27 1 526 and U.S. Pat. No. 5,124,126.

In the present case "container" refers to, in particular, a container which is used for temporary storage of waste, such as household waste, compost waste, twigs and branches from gardening and the like, but is not limited thereto. It is well known that twigs and general garden waste take up much space when they are placed in such containers and the saving one obtains by compacting is obvious.

However, the invention one shall not be limited to the mentioned products/waste types or container types, as it generally concerns containers that store different products to be compressed.

With the invention one aims in particular to provide a new construction of a compacting mechanism in a lid construction to compress the content of such containers.

It is a further aim of the invention to provide a compression solution which is easier to integrate with lid constructions than the previously known solutions.

It is a further aim of the invention to provide a solution for a compacting mechanism in a lid construction of a container whereby one can compress the content (waste) of the container so that there will be room for more content (waste).

Furthermore, it is an aim of the invention to provide a lid construction with a compacting mechanism, and which can be connected to a docking station where the waste containers are inserted, the lid put on and the content of the container be compressed.

It is also an aim of the invention to provide a new docking station for waste containers.

In those cases related to waste containers which are emptied by a waste collection company, it is an aim to provide a solution where the container can be brought to contain more waste. The number of times such containers need emptying can influence the price the user must pay to the waste collection company/local council. If the container can take more waste or waste disposal bags, the costs related to the waste collection company can be reduced correspondingly.

The device according to the invention is characterised in that it comprises a moment arm construction which on rotating is set up to push a compacting element down into its active compacting position and thereafter pull it up into its passive rest position.

Especially preferred is the moment arm construction integrated in the lid. The moment arm construction comprises a relatively longer arm part which is firmly connected with a relatively shorter arm part and where the moment arm is rotary mounted in the lid.

According to a preferred embodiment, the longer arm part and the shorter arm part form an angle $\alpha$ of about 120° with each other.

According to a preferred embodiment the moment arm construction is set up to work on the element via a hinged connecting arm which, with its one end, is rotary mounted to the shorter arm part and the other end of the connecting arm is mounted to the compressing element in the form of a plate so that it can partially move and rotate.

According to a preferred embodiment, it comprises two mutually cooperating moment arm constructions comprising two longer arm parts which are mutually connected at the free ends with a handle.

According to a preferred embodiment the device comprises a guiding body for guiding the movements of the compacting element downwards and upwards. The guiding body is a telescopic construction, where the two end parts of the construction are fastened to the container lid and to the upper side of the compacting element, respectively, and it comprises a number of between lying telescope parts, in particular, one between lying telescope part.

The telescope parts are formed by a square-shaped tube. The guiding body is preferably arranged in the plate element between the two longer arm parts.

The compacting element is preferably a plate body with a compacting plate corresponding to the internal cross-section of the container and when the container is tapered down towards the bottom, the plate can have a surface area corresponding to the cross section area of the bottom of the container. The compacting element has preferably a grid or lattice form.

The docking station according to the invention is characterised in that it comprises:

a) a mechanism for positioning and centring of the container in the station
b) an integrated lid construction with a compacting mechanism for compressing the content of a container which is placed in the station, and
c) a device to rotate the lid construction of the station between raised position and a position placed down in the opening of the container as it is described in the characteristic in claim 12.

The preferred embodiments of the docking station according to the invention appear in the dependent claims 13-18.

The docking station is in particular characterised in that the integrated lid construction with the compacting mechanism is constructed as given in claims 1-12.

According to the invention, the invention is used for handling waste in a typical waste container, especially one which is used for bags of domestic refuse or for residual waste, compost waste, twigs and branches from gardening and the like.

According to the invention, the invention is used in a docking station with a docking rack for placing of the containers with waste, as the lid is put on, the compacting function is carried out and the container is removed again whereupon the docking station is ready for the next user.

According to the invention, the invention is used in a loose lid for placing, for example, in a common garbage room where one or more compacting lids are available in the room, as the container lid is flipped open, the compacting lid is put on, fastened to the opening edge of the container and performs its compacting function and is removed again to be used with the next container where waste is to be compacted.

There are a series of advantages gained with the invention. It is cheap to produce. It has a low weight, it is simple to construct and operate as it is integrated into the lid itself. The need for maintenance and service is minimal. Furthermore, one obtains that all waste will easily fall out in the emptying, as the container is tapered towards the bottom. One also achieves that the stroke of the compacting plate, normally limited up to 25 cm for a solution where domestic refuse is compressed, is such that one avoids waste being forced out of a tied waste bag.

Tests with the invention have shown that in operating with the compacting arm a user force of 30 kg will give a compacting force of about 250 kg from the compacting plate which presses the waste together. This can mean that one obtains an extent of compression of about 50%, i.e. if there are originally 8 bags in the container one can place a further 8 bags in the container after the compacting operation.

Other advantages are that the invention is simple to keep clean, simply by flipping up the lid one has full access, for example, to be able to hose down, wash or carry out any other form for cleaning.

According to the invention, the device is used in the handling of waste in a typical waste container, in particular, one which is used for domestic waste, compost waste, twigs and branches from gardening and the like.

The invention shall now be explained in more detail with reference to the enclosed figures, in which:

The FIGS. 1A and 2 show two perspective diagrams seen from the above and below, respectively, of a lid with a compacting device according to a preferred embodiment of the invention. Both the figures show the operating arm of the construction inside the lid, while FIG. 2 shows a compacting plate for the material placed in the bottom part of the lid.

FIG. 1B also shows the advantageous initial position of the arm 40*b* at the start of the rotary movement.

Figure 4:
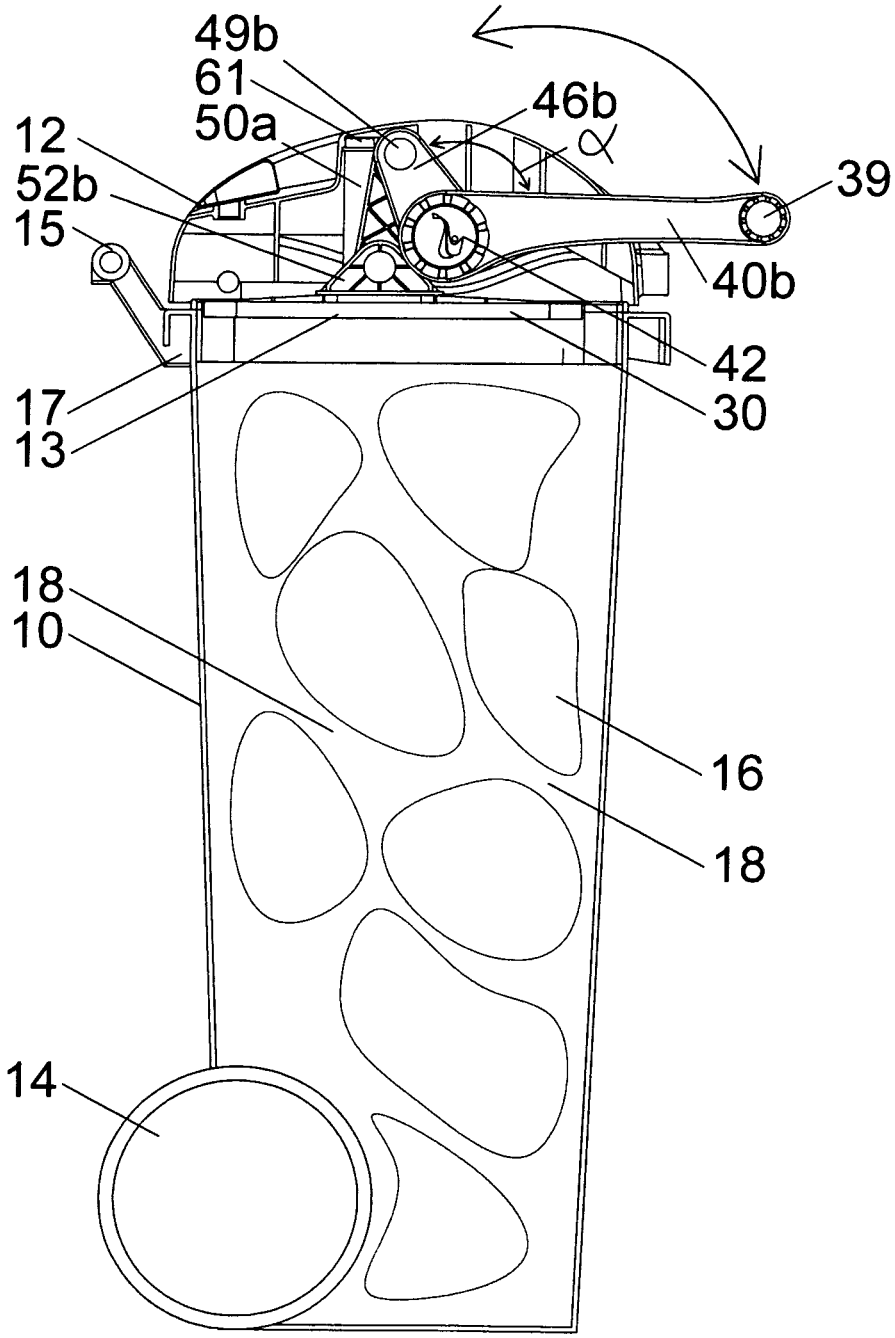
FIG. 4 shows a perspective partial diagram of the lid according to the invention adapted as a lid to a common waste container, for example, for normal households.

The invention shall now be explained by first referring to FIG. 4 which is a perspective diagram of a waste container 10 with lid 12, wheels 24 and pushing handle 15. The lid 12 of the container is hinged at 19 and is shown in the figures flipped down so that the opening of the container is closed. The lid 12 is flipped down and closed with the help of a locking loop or a catch mechanism. When the container is moved the user grabs the handle 15, flips the container backwards so that it only rests on the wheels 14 and can be wheeled away.

Figure 1A:
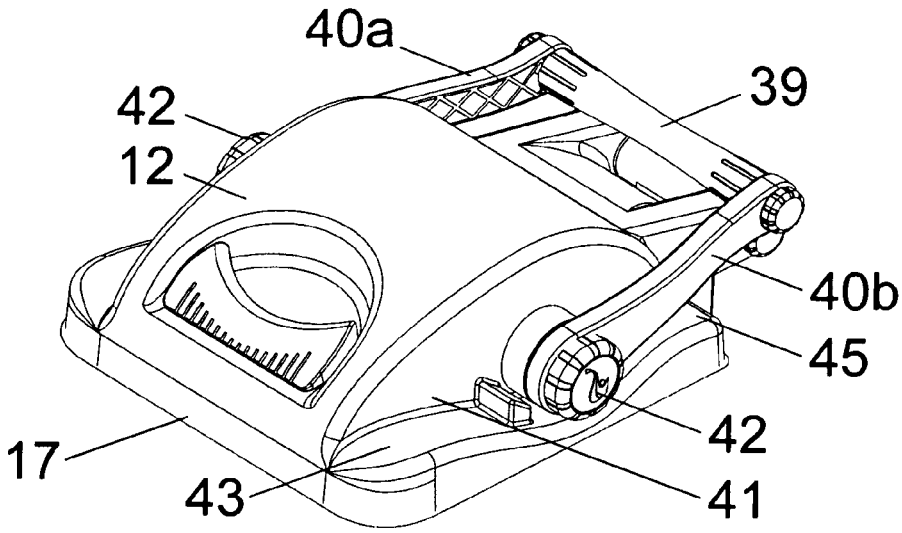
FIG. 1B shows the angle deflection when the operating arm 40*b* rotates to perform the compacting.
Figure 1B:
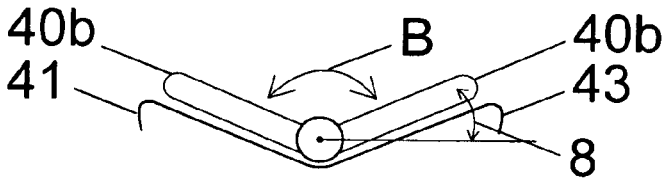
Figure 2:
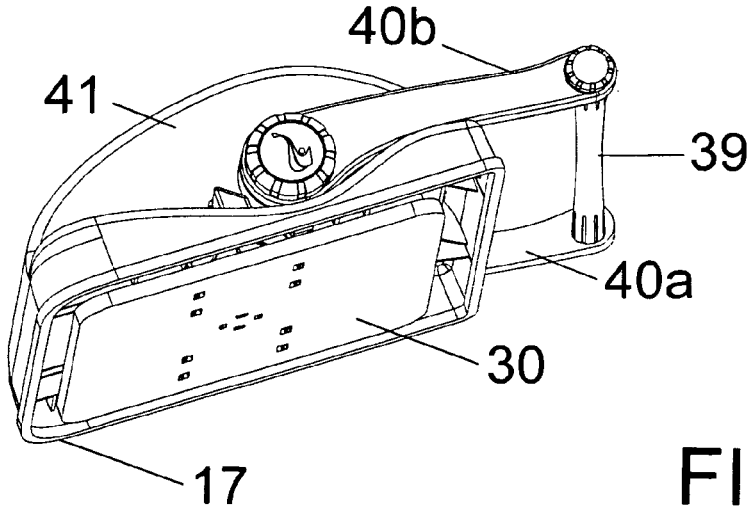

The lid 12, which is shown in the FIGS. 1 and 2 with sidewall 41, has a cupola or a dome shape to be able to contain the compacting mechanism internally according to the invention. Internally, the lid comprises a moment arm connected to a telescopic guiding body with a compacting plate to compress waste that is placed in the container.

The container 10 is normally widest at the top and tapers down towards the bottom. Most containers have such basic shape, but some can have straight sidewalls so that internally they are as wide at the top as they are at the bottom.

As can be seen in FIG. 4, a number of plastic bags 16 with waste (shown as circles) are placed in the container 10. It can be seen that there is much space or "air" 18 around each bag 16 and to reduce this volume one can press the bags together and down in the container manually.

According to the present invention, formed into the lid 12 is the above mentioned mechanism which is used to compress the content (the bags 16) in the container. A plate or grid 30 is arranged to be forced downwards so that it presses the content of the bags 16 together.

The lid construction 12 comprises a rotary handle with a handle bar 39 running across, and from each end of the handle bar 39, an arm part 40*a* and 40*b*, respectively, extends forward to a mounting 42 in the lid wall 41. Through the mounting 42 a shaft 44 of rotation runs through the sidewall, through the inner hollow space of the lid and out through the opposite sidewall. When the handle 30 is lifted, the rotary arms 40*a*, 40*b* are rotated and the shaft 44 is rotated about the mounting 42. Inside the sidewall, a shorter arm part is firmly fastened onto the shaft 44. The two pairs of arm parts 40*a*,46*a* and 40*b*,46*b*, respectively, are consequently firmly connected with each other and define the arm parts in a moment-giving rod. Each shorter arm part 46*a*,46*b*, forms a shorter moment arm in the pair, while each longer arm part 40*a*,40*b* forms the longer moment arm in the pair.

When the arms 40*a*,40*b* rotate with a force F, the force is multiplied as the end 48*a*,48*b* of the shorter moment arm exerts against a body which in turn shall exert a compacting force. The basic principle is: force×arm (length)=moment. According to the invention, a such multiplied force is transferred to a compacting plate 30 which is mounted to the mechanism inside the lid to press the waste together.

Figure 5:
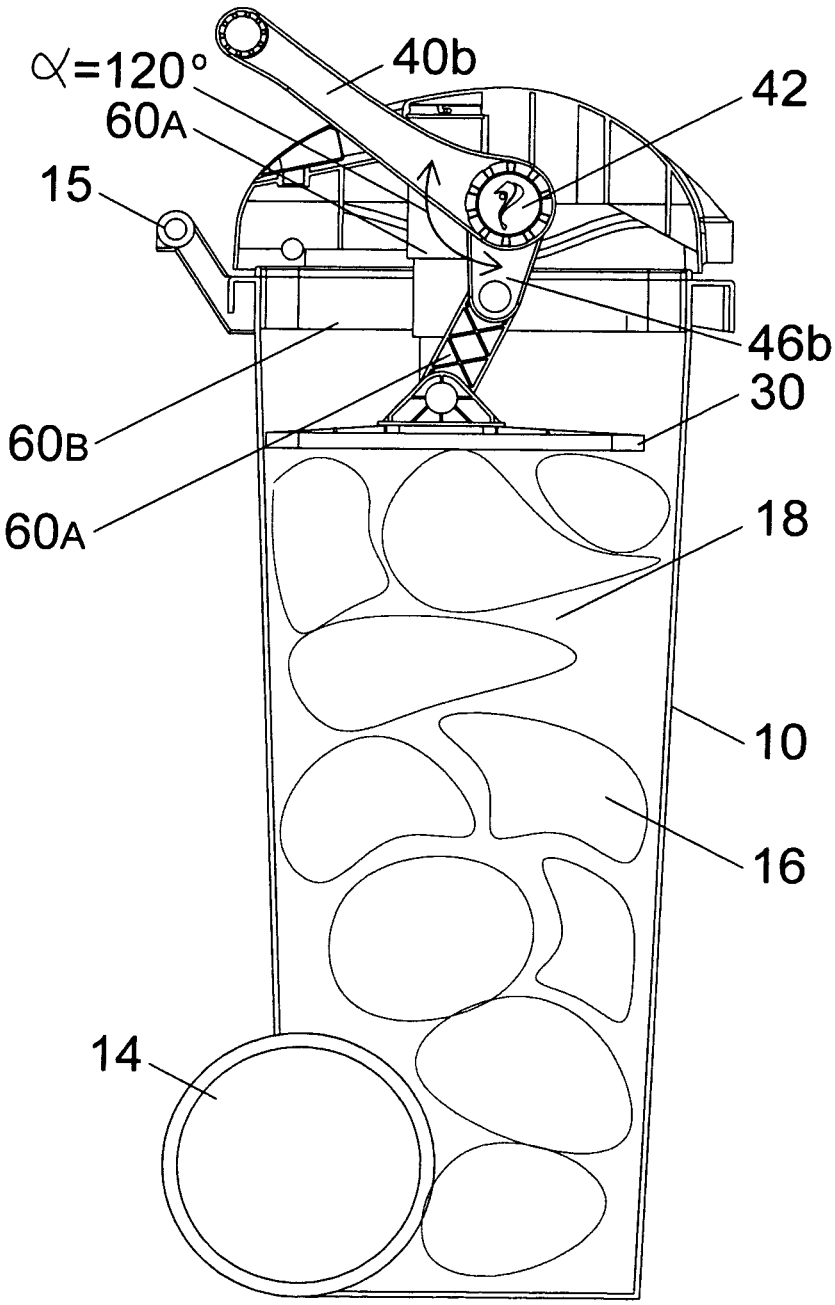
FIG. 5 shows a corresponding side diagram similar to FIG. 4, but where the operating handle (hereinafter denoted the handle) is readjusted so that the compacting plate is in its active compacting position for compressing the content.

The long and short mutually firmly connected moment arms 40 and 46, respectively, form an angle $\alpha$ of about 120° with each other (see the FIGS. 4 and 5). The angle $\alpha$ between the two arms can preferably lie in the region 90 to 150°.

A connecting arm 50*a* and 50*b*, respectively, connects the end section 48*a*,48*b* to the shorter moment arm 46*a*,46*b* with a point of fastening 52*a*,52*b* on the topside of the compacting plate 30. Both the connecting arms 50*a*,50*b* are rotary connected to the respective arm parts 46*a* and 46*b*, respectively, via hinged bolts 49*a* and 49*b*, respectively, at the one end, and they are rotary connected at their other ends to a fastening bracket 52*a* and 52*b*, respectively, via a second set of hinged bolts 53*a* and 53*b*, respectively.

When the arm parts 40 rotate in an arch from a passive position to an active position so that the shaft 44 is rotated, the shorter moment arm 46 is swung downwards in an arch shape (from the position in FIG. 2 to the position in FIG. 3), and forces the connecting arms 50 downwards so that the compacting plate 30 is led downwards. As the arm 50 is hinged both at the shorter moment arm 46 and in the top bracket 53 on the compacting plate 30, the arm 50 is flexible and can change its angle in relation to the vertical, as can be seen in the FIGS. 4 and 5.

For the present construction the ratio between exerted force by the user and the force which is exerted onto the compacting element varies in the following particularly favourable way: At the start of the movement much force from the user results in little force onto the compacting element 30 itself. At the end of the swing cycle, little force from the user gives a higher force on the compacting element. This is particularly favourable because it is at the end of this movement that one needs much force onto the compacting element with the smallest possible force from the user. At the start of said movement one has just begun the compression of the waste.

As shown in the FIGS. 1-4 the swing movements of the handle arms 40 are limited by the top surface of the lid being formed with a contour such that the two contacting surfaces 43 and 45, respectively, for the arm 40*b* (recessed under the top surface level of the main lid) on either side of the axis point 42, forms an angle β with each other of the order of about 140 to 180° as indicated in FIG. 1B. A top surface angle of 180° will then mean that the sunken surface 43,45, of the lid is completely plane. It is preferred that the arms 40, in their initial position, form an angle 8 of the order of 10 to 30 degrees with the horizontal, as also shown in FIG. 1B. When the user stretches his arm forwards and grips the handle 39, he can start the movement by pulling straight towards himself more than having to lift the handle vertically upwards, as the arm naturally is swung upwards.

Initially, it is sufficient with one set of longer and shorter moment arms 40 and 46, respectively, and one single intermediate plate for the mechanism to be able to work. However, with only one pair, the horizontal position of the plate can not be guaranteed, something which again can influence the function in a detrimental way.

Figure 3:
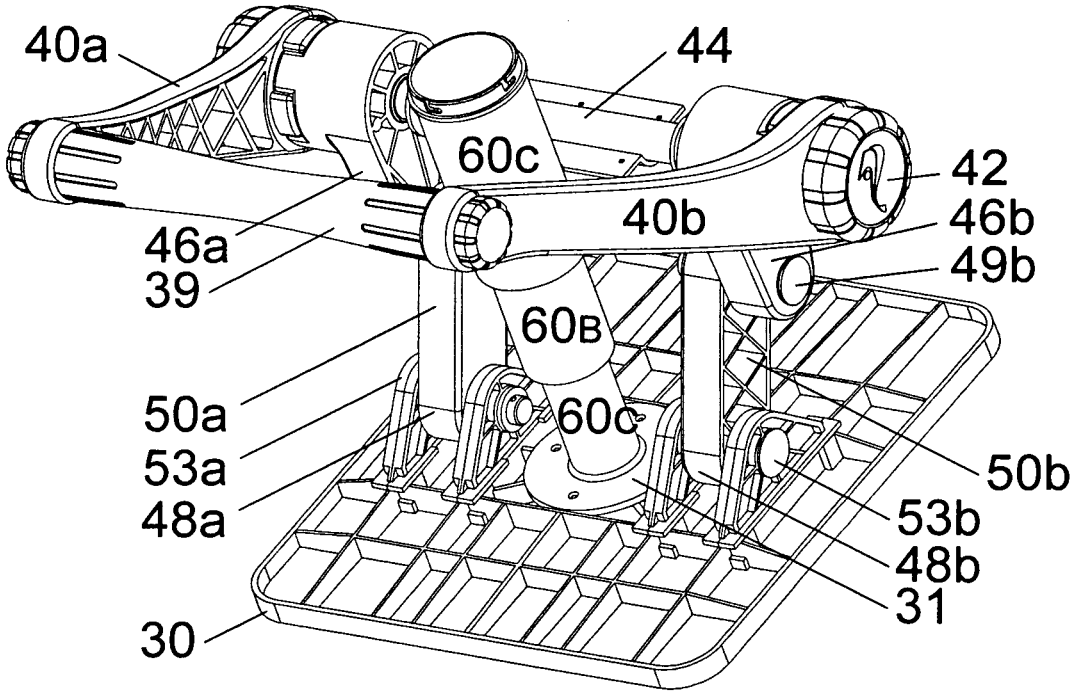
FIG. 3 shows in perspective the construction of the compacting mechanism inside the lid. The compacting mechanism is readjusted from its passive rest position (FIGS. 1 and 2) inside the lid to its active compacting position in that the operating handle is swung over to the left.

The solution which is described in FIG. 3 is therefore preferred according to the invention: Two parallel first (longer) moment arms 40*a*,40*b* are firmly connected to two associated parallel second (shorter) moment arms and where these are connected to the top surface of the compacting plate 30 via their separate connecting arms 50*a* and 50*b*, respectively, i.e. that the two moment arms are fitted to the top side of the plate 30 on their own side of one or more guiding bodies (60*a*,60*b*,60*c*) as shall be explained in the following.

The guiding body 60 shown in the FIGS. 3, 4 and 5 stabilises the plate 30 when this is pushed downwards and is pulled upwards by the rotation of the moment arm 40. The guiding body 60 comprises an element with a telescopic shape with three telescope segments. A first fixed telescope segment 60A is fastened to the lid 12 at the underside at 61 by a segment not shown in FIG. 4. An intermediate telescope segment 60B is arranged so that it can be extended and coaxially collapsed into the first segment 60A. The innermost telescope segment 60C is at its lower edge fastened to the top side of the plate 30 via a disc-formed plate part 31. The telescope parts are further constructed in an itself known way, with stopping edges or the like so that the middle and lower telescope parts 60B,60C can not come loose from each other.

As can be seen in FIG. 3, the disc-formed plate part 31 (at the bottom on the telescope rod 60C) is firmly fixed to the top side of the compacting plate 30 and ensures that the compacting plate retains its horizontal position. At the top, the telescope part 60*c* is mounted so that it can move via a joint at the top of the lid such that the collapsing of the telescope segments (60*a*-60*c*) and plate 30 can be moved vertically, and the compacting plate 30 does not rotate more than it must so that it is stabilised in its horizontal position.

According to a preferred embodiment, the telescope parts are made from square tubes so that the tubes and the plate can not mutually rotate.

The advantage of using a telescope construction is that when it is collapsed completely (FIG. 3) it extends down under the lid by only ⅓ of its total extended length (FIG. 4). When collapsed it can thereby, together with the compacting plate, be completely fitted in under the lid, cf FIG. 2. The lid comprises a lock construction which is operated manually so that the moment arms can be locked in their passive position with the compacting plate 30 pulled up under the edge of the lid 17. This lock construction can be a locking bolt (not shown) which the user pulls back so that the arms 40 are not hindered in their movements.

There is also another great advantage with the compact telescope construction and the placing of the handle bar. When the lid is flipped upwards, there are no parts which protrude further back than the hinge point of the lid (see FIG. 7). The docking station can thereby be placed up against a wall without the lid coming near the wall when it is flipped upwards.

According to the invention the compacting element 30 is a plate element with a compacting surface corresponding to the internal cross section of the container. The container preferably tapers down towards the bottom so that the waste can easily fall out when the container is emptied, and in this case the plate has a surface area corresponding to the cross sectional area of the container bottom. The compacting element 30 can also have a grid or lattice form.

The Use of the Lid Construction According to the Invention.

Taking FIG. 4 as the starting point, the user grabs the handle and pulls this towards himself so that it is swung in an arch-shape over to the position which is shown in FIG. 5. The shorter moment arm 46 is rotated correspondingly in an arch downwards and makes the telescope part 60 to be pulled out so that the plate 30 is pushed downwards to its lowest bottom position. When the compacting is completed, the user pushes the handle 39 back to its position shown in FIG. 4, with the compacting plate in its collapsed position.

The lid with the compacting mechanism according to the invention can be used in two ways:

1: As a part of the lid of the waste container. This method of use is illustrated in the FIGS. 1-5.

2: Fitted to a specially constructed docking station at every user, where the lid is placed down onto the opening of the container when the container is placed with the user.

Figure 6:
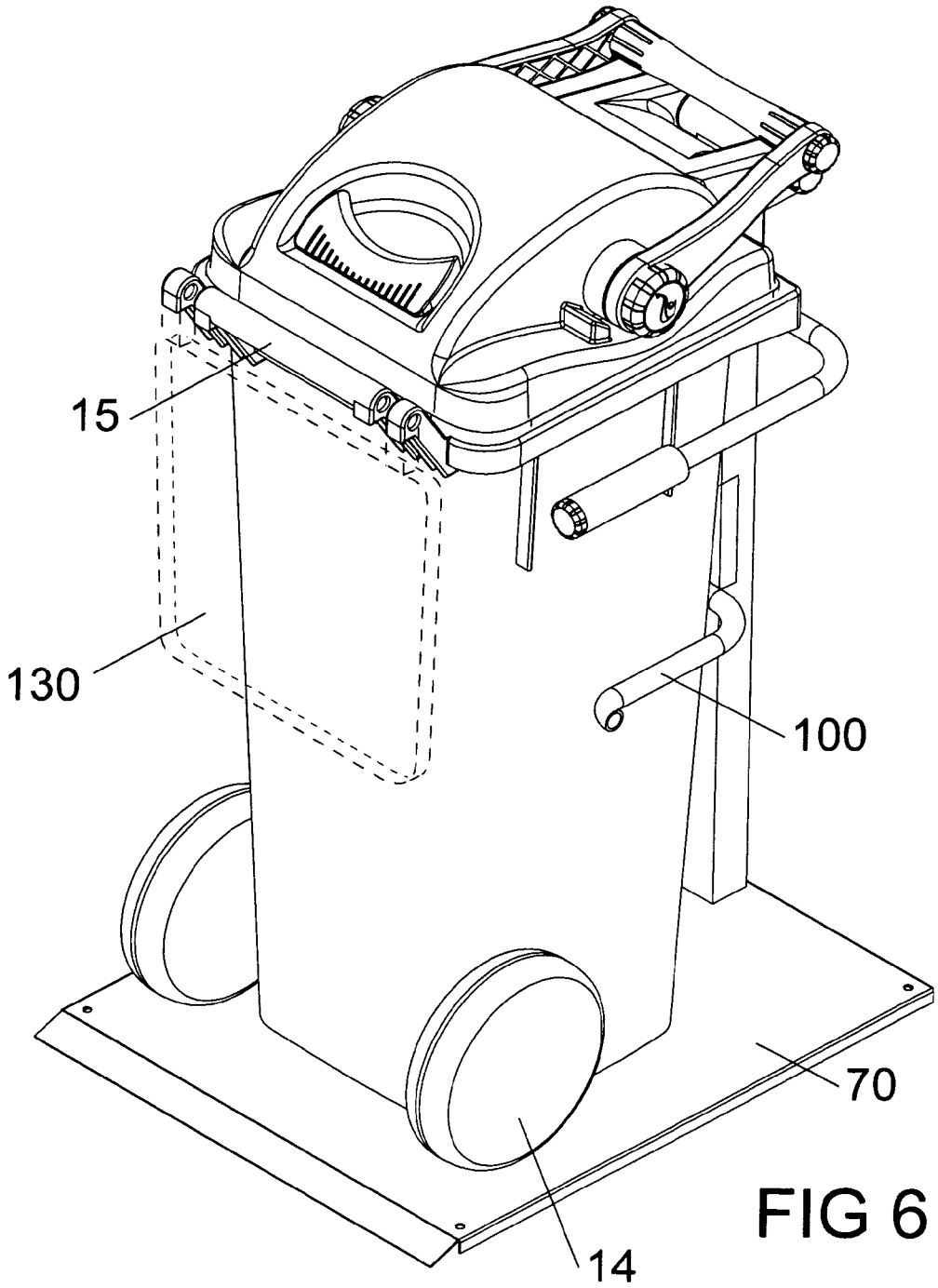
FIG. 6 shows a perspective diagram of a lid with the inventive compacting mechanism fitted as a rotary lid part in a docking station. A traditional waste container with lid is placed in the docking station and its lid part is put down onto the opening of the container to compress the material in the container.

The second way it can be used shall be explained in the following with reference to the FIGS. 6, 7 and 8:

The lid with the compacting mechanism is placed uppermost in a docking station which shall now be explained in more detail.

Figure 7:
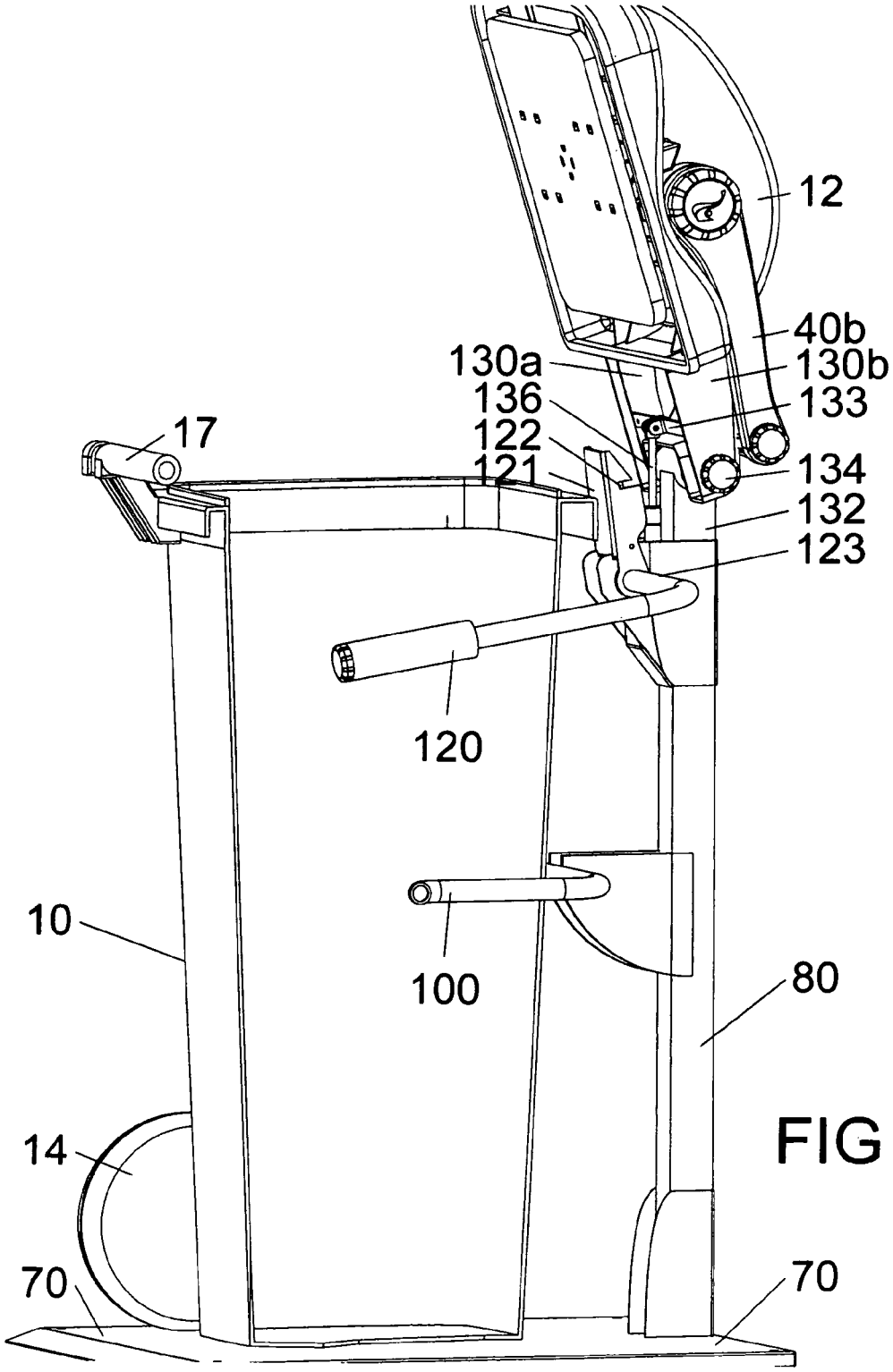
FIG. 7 shows again schematically the container placed in the docking station where parts of the container are cut away to help the illustration, and where the lid of the docking station is swung up into its open position.
Figure 8:
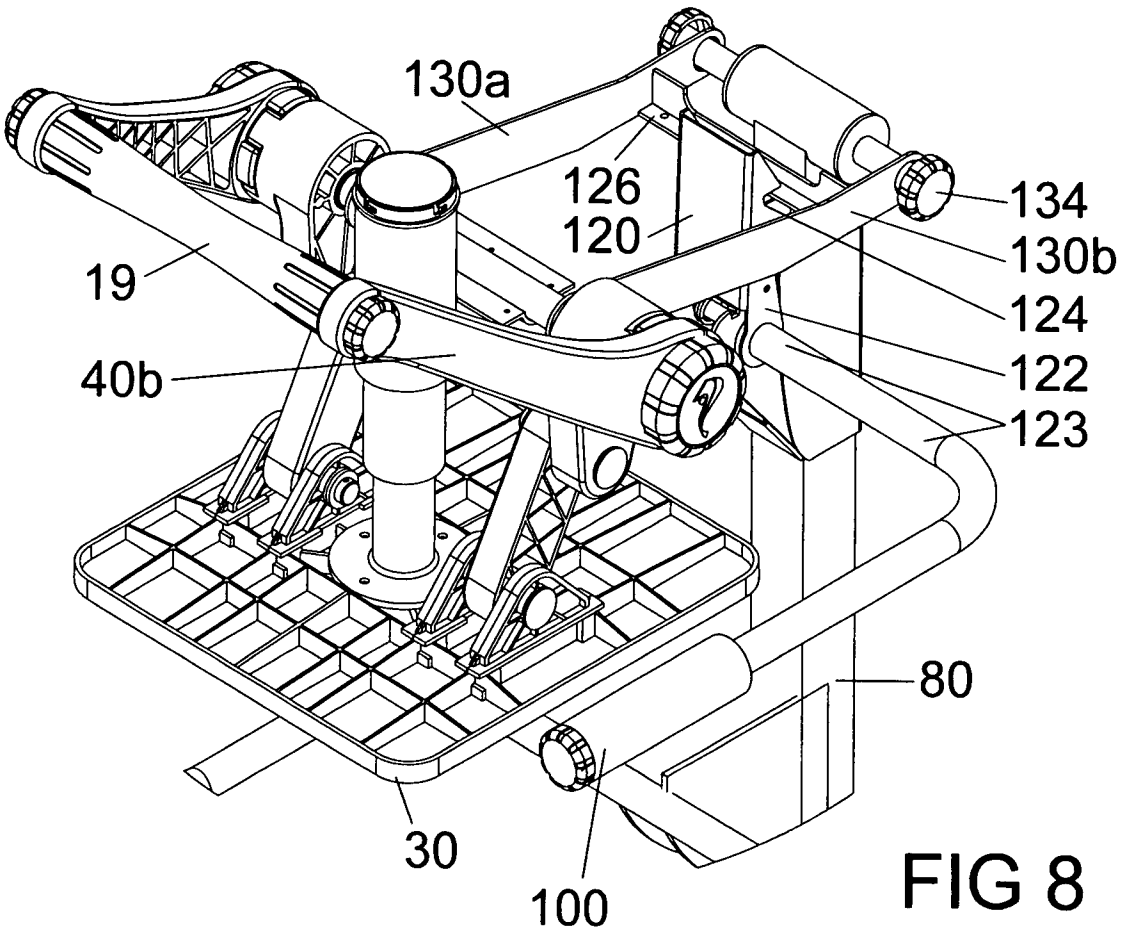
FIG. 8 shows the operating mechanism of the lid as shown in FIG. 3, and in addition, how the lid is rotary fastened in the docking station.

The rack is composed of a base plate 70, a vertical column 80 with the lid 12 fitted on top so that it can rotate, a mechanism 100 to centre a waste container in the docking station, an appliance 120 to swing the lid between its position in a container (FIG. 6) and its flipped open position (FIG. 7).

These elements 70,80,100,120 are clearly shown in FIG. 7.

The base plate 70 stands on the ground and a waste container is rolled onto the plate. A vertical trusswork frame column 80 is fitted at the rear end of the plate. Two approximately horizontally directed centring arms 100 mutually spaced apart are fitted on the column. A container is rolled onto the plate and forced in so that the arms 100 get a grip and squeeze around it approximately halfway up on the container which is thereby held steadily in the station. When the lid of the docking station shall be used, the lid 130 of the container is rotated up and dropped down along the outside as indicated schematically with the dotted lines in FIG. 6.

The lid is fastened at the top of the rack so that it can rotate. Two mutually parallel arms 130*a*,130*b* extend out from the rear part of the lid 12, i.e. opposite the operating handle 17 of the container 10. The arms are rotary mounted to a frame construction 132 at the top of the column, and rotary about a horizontal shaft 134.

FIG. 7 shows the lid 12 rotated up into its open position where there is free access to the inside of the container. To hold the lid 12 steadily in this position, a pressure cylinder 136 is fitted between the rack frame 132 and a frame part 133 in the arm parts 130*a*,130*b* of the lid. The cylinder 136 is under tension (increased pressure inside the cylinder chamber) when the lid is rotated down and positioned on the container (FIG. 6) and released (reduced pressure in the cylinder chamber) when the lid is swung up into an open position (FIG. 7).

Instead of a pressure cylinder, a tension spring which can function in the same way can be used.

To hold the lid 12 in place when swung down onto the container 10, the upper part of the column 80 comprises a pre-stressed locking bolt that can be flipped open. The bolt 121 is a plate-formed body which, at its lower end 123, is mounted to the rack, while its upper section comprises a locking slit or a groove 124 set up to engage in a horizontal rail 126 in the fastening construction of the lid 12 to the column, so that the lid is fixed in its shut position on the container when the piston/spring is under maximum tension. At its lower edge, the locking bolt 121 is flipped about its axis 123 against the strength of the spring which forces the spring to flip into locking position to the rail when the lid is placed onto the container.

The locking bolt 120 is operated and is flipped out by operating the handle 100. When the user pushes the handle down, the slit 122 of the bolt 120 is flipped out of its engagement with the locking rail and the pressure cylinder/spring releases its pushing force and flips the lip up to its open position which is shown in FIG. 7.

Thereby, the user can simply operate the waste container, by operating the handle 100 and flipping open the lid so that he can place waste in the container. Thereafter, he pushes the lid down again against the opposing force of the spring.

With the inventive mechanism, the lid is locked with the compacting plate automatically in its lower position so that waste in the container is subjected to the downwards pressure. This helps the compression of the waste/material with a memory, i.e. in those cases where the material goes back into its original shape.

When the container, after a number of such operations, starts to be filled, the user can, in addition, pull the handle 19 so that the compacting plate is moved down and presses the content together.

What is claimed is:

1. Lid construction arrangement for compression of the content of a container, where compacting element of said lid is arranged to exert pressure down onto said content in order to compress it, characterised in that said arrangement comprises a moment arm construction which, by rotating, is made to push the element down to its active compacting position, and pull it up to its passive rest position, said moment arm construction comprising a relatively longer arm part which is firmly connected to a relatively shorter arm part and where the moment arm is rotary mounted in the lid, said longer arm part and said shorter arm part forming an angle a of about 120° with each other, and wherein said moment arm construction is arranged to work on said compacting element via a hinged connecting arm which, at its one end, is rotary mounted to said shorter arm part and the other end of said connecting arm is rotary fitted to said compacting element.

2. Lid construction arrangement according to claim 1, characterised in_that the moment arm construction is integrated in the lid.

3. Lid construction arrangement according to claim 1 characterised in that it comprises two mutually cooperating moment arm constructions comprising two longer arm parts which are mutually connected at their free ends with a handle.

4. Lid construction arrangement according to claim 1 characterised by a guiding body for guiding the movement of the compacting element upwards and downwards.

5. Lid construction arrangement according to claim 4 characterised in that the guiding body is a telescope construction, where the two end sections of the construction are fastened to the lid of the container and the top side of the compacting element respectively, and it comprises a number of between lying telescope parts in particular one between lying telescope part.

6. Lid construction arrangement according to claim 4 characterised in that the guiding body is set up in the compacting element between the fastening points of the two longer arm parts to the plate.

7. Lid construction arrangement according to claim 5 characterised in that the telescope parts are made from a square tube.

8. Lid construction arrangement according to claim 1 characterised in that the compacting element is a plate element with a compacting surface corresponding to the internal cross section of a container, and when the container tapers down towards the bottom, the plate can have a cross section area corresponding to the cross section area of the bottom of the container.

9. Lid construction arrangement according to claim 1 characterised in that the compacting element has a grid or a lattice form.

10. The combination comprising a lid for mounting on a container;

a compacting element for compacting material in the container; and a compacting, mechanism mounted on said lid for reciprocally moving said compacting element in the container for compacting material therein, said compacting mechanism including a shaft rotatably mounted on said lid, a handle having a first pair of parallel arms fixedly mounted relative to said shaft to rotate therewith and a handle bar extending to and between said arms at a respective end thereof, a second pair of arms fixedly mounted relative to said shaft to rotate therewith and forming an included angle with said first pair of arms between 90° and 150°, and a third pair of arms, each said arm of said third pair of arms being pivotally connected to and between one end of a respective one of said second . pair of arms and said compacting element.

11. The combination as set forth in claim 10 further comprising at least one telescoping guiding body secured to and between said compacting element and said lid.

12. The combination as set forth in claim 10 further comprising a container having said lid hingedly mounted thereon and being of tapered shape from top to bottom thereof.

* * * * *

UNITED STATES PATENT AND TRADEMARK OFFICE

CERTIFICATE OF CORRECTION

PATENT NO. : 8,584,582 B2
APPLICATION NO. : 12/737236
DATED : November 19, 2013
INVENTOR(S) : Arvid Johannesen, Jr.

It is certified that error appears in the above-identified patent and that said Letters Patent is hereby corrected as shown below:

Title Page, Item (73) Assignee: "MPE Prodvers AS" should be --MPE Products AS--

Signed and Sealed this
Twenty-eighth Day of January, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,584,582 B2
APPLICATION NO. : 12/737236
DATED : November 19, 2013
INVENTOR(S) : Arvid Johannesen, Jr.

It is certified that error appears in the above-identified patent and that said Letters Patent is hereby corrected as shown below:

In the Claims

Claim 10, col. 8, line 58, “second . pair” should be --second pair--

Signed and Sealed this
Fifteenth Day of April, 2014

Michelle K. Lee

Michelle K. Lee
*Deputy Director of the United States Patent and Trademark Office*